United States Patent [19]

MdDowell

[11] 4,397,106

[45] Aug. 9, 1983

[54] DREDGE BUCKET WHEEL STRUCTURE

[75] Inventor: Alexander W. K. MdDowell, Annapolis, Md.

[73] Assignee: Ellicott Machine Corporation, Baltimore, Md.

[21] Appl. No.: 346,996

[22] Filed: Feb. 8, 1982

[51] Int. Cl.[3] ..... E02F 3/88

[52] U.S. Cl. ..... 37/57; 37/66; 37/DIG. 2

[58] Field of Search ..... 37/DIG. 2, 66, 70, 189, 37/190, 57; 198/703, 713, 702, 509, 495

[56] References Cited

U.S. PATENT DOCUMENTS

| | | | |
|---|---|---|---|
| 288,197 | 11/1883 | Ackerly | 198/713 |
| 903,210 | 11/1908 | Lkiericz | 37/66 |
| 2,722,759 | 11/1955 | Cosenza | 37/66 |
| 3,461,580 | 8/1969 | Sebold | 37/189 |
| 3,476,498 | 11/1969 | Von Bolhar | 37/189 X |
| 4,242,814 | 1/1981 | Fluks | 37/189 X |

FOREIGN PATENT DOCUMENTS

| | | | |
|---|---|---|---|
| 697261 | 10/1940 | Fed. Rep. of Germany | 37/66 |
| 1207355 | 9/1970 | United Kingdom | 37/66 |
| 613014 | 6/1978 | U.S.S.R. | 37/DIG. 2 |
| 635176 | 11/1978 | U.S.S.R. | 37/DIG. 2 |
| 789651 | 12/1980 | U.S.S.R. | 37/DIG. 2 |

*Primary Examiner*—Clifford D. Crowder

*Attorney, Agent, or Firm*—Scrivener, Clarke, Scrivener and Johnson

[57] ABSTRACT

An improved bucket wheel for a dredge having a flush jet arrangement for clearing the buckets of sticky material, an improved divider arrangement for preventing entrance of oversized objects into the buckets and means for expelling air trapped in buckets when the wheel is operating only partially submerged. The flush jet operates through the open bottom of each bucket to expel matter from the buckets substantially radially outwardly. The air expeller is an escape path, such as a chordal flat, between the hub and rim of the wheel in the region where air might be trapped by the buckets. The divider is a plate securely attached to each bucket of adjacent pairs of buckets and lying in the mid-plane of the wheel.

10 Claims, 4 Drawing Figures

DREDGE BUCKET WHEEL STRUCTURE

This invention relates to dredges and more particularly to improvements in the wheels of bucket wheel dredges.

The present invention is directed to improvements in the wheel for a bucket wheel dredge of the type shown and described in U.S. Pat. No. 3,476,498 and assigned to the same assignee as the present invention. A dredge bucket wheel is mounted on the end of a dredge ladder and comprises a stationary hub section and a rotating rim section. The rim section comprises, generally, a circular plate or the like fixed to a driven shaft, and attached to the periphery of the plate is one side of each of a plurality of circumferentially spaced buckets which are open at their bottoms and span the mid-plane of the wheel perpendicular to its axis of rotation. The opposite sides of the buckets may be attached to an annular flat, hoop-like member with the buckets, in effect, cantilevering over the wheel mid-plane. In order that the buckets may retain spoil scooped into them as the rim rotates, the hub section is provided with a cylindrical surface which, at least in the region where the buckets must retain spoil therein, is in close adjacency to the otherwise open bottoms of the buckets, the cylindrical surface in this region providing floors for the buckets. As the loaded buckets are rotated further, they are swept past a circumferentially extending opening in the cylindrical surface which permits the spoil in the buckets to drop into or be conveyed into by water flow a hopper within the hub section which is connected to a suction pipe which withdraws the spoil as it is deposited in the hopper.

One of the problems associated with bucket wheel dredges is the adherence of sticky spoil in the buckets. Dislodging this material has proved difficult and in the prior U.S. Pat. No. 3,476,498 a mechanical scraper arrangement is disclosed. Another arrangement for disloding material stuck in the buckets is shown in the U.S. Pat. to Lkievicz No. 903,210 where a nozzle projects a stream of water tangentially at the buckets as they are moved past their discharge positions. The problem with this arrangment is that the nozzle must, perforce, be spaced a sufficient distance away from the path of movement of the buckets so as to be clear thereof and where the nozzle is submerged, the back pressure of the surrounding water impedes fluid flow from the nozzle and, in addition, the tangential flow tends to drive the spoil into the bucket, which is inefficient, and tangential flow also opposes rotation of the cutter wheel.

One of the objects of the present invention is to improve nozzle flushing of the buckets of a bucket wheel dredge by directing the pressurized fluid through the interior of the hub section and arranging the nozzle exit at the periphery of the hub section so that the exit is as close as possible to the open bottom of the buckets as they sweep by, thus minimizing back pressure problems, and, at the same time, the fluid stream is projected into the buckets substantially radially outwardly so that the material is flushed directly out of the buckets and the stream has little adverse effect on the rotation of the wheel.

When a bucket wheel dredge is used in placer mining, that is to say, in a region where a mineral is close to the surface, and a cutter wheel dredge floats in a relatively shallow pool of water and extracts spoil with the cutter wheel only partially submerged, it has been discovered that after a bucket has discharged its load and is rotated to its inverted position enroute to its spoil scooping position, the bucket will trap air therein which may enter the hopper where it can be entrained as a bubble in the suction pipe to air-bind the suction pump.

Thus another object of the present invention is to overcome the foregoing problem by providing between the hub and rim sections in the region where air can be trapped in the buckets of a partially submerged wheel, means defining a fluid flow path, such as a chordal flat in the cylindrical surface of the hub section, to allow any air which would otherwise be trapped in the buckets to escape. The flow path means also allows water in the buckets of a fully submerged wheel to escape so as to lessen to some extent resistance to wheel rotation.

In bucket wheel dredging, the buckets can pick up large objects, such as rocks, which should not be allowed to enter the hopper. In prior U.S. Pat. No. 3,476,498, referred to above, objects were excluded from the hopper by the use of "grizzly" bars across the hopper entrance. Though this is a partial solution, with such an arrangement the buckets are still capable of picking up large objects and when these are in the buckets they lessen the amount of pay dirt which the buckets can deliver. Thus, it is preferable to exclude large objects from the buckets themselves and its has been proposed to provide radially circumferentially extending divider plates between pairs of adjacent buckets as shown, for example, in the U.S. Pat. to Sebold No. 3,461,580. In that patent the plates are attached to the rear upper surface of one bucket and extend circumferentially towards but not as far as the following bucket. This arrangement is not satisfactory for heavy duty, high speed dredging or excavating because the cantilevered arrangement of the patented plates permits them to be bent out of the wheel mid-plane thus permitting oversize objects to enter the bucket.

It is therefore another object of the invention to provide divider plates for a wheel type excavator which are strongly supported at both ends and resist to a high degree forces tending to bend the plates out of the mid-plane of the wheel.

The foregoing and other objects of the invention will become apparent as the following detailed description is read in conjunction with the accompanying drawings wherein.

Figure 1:
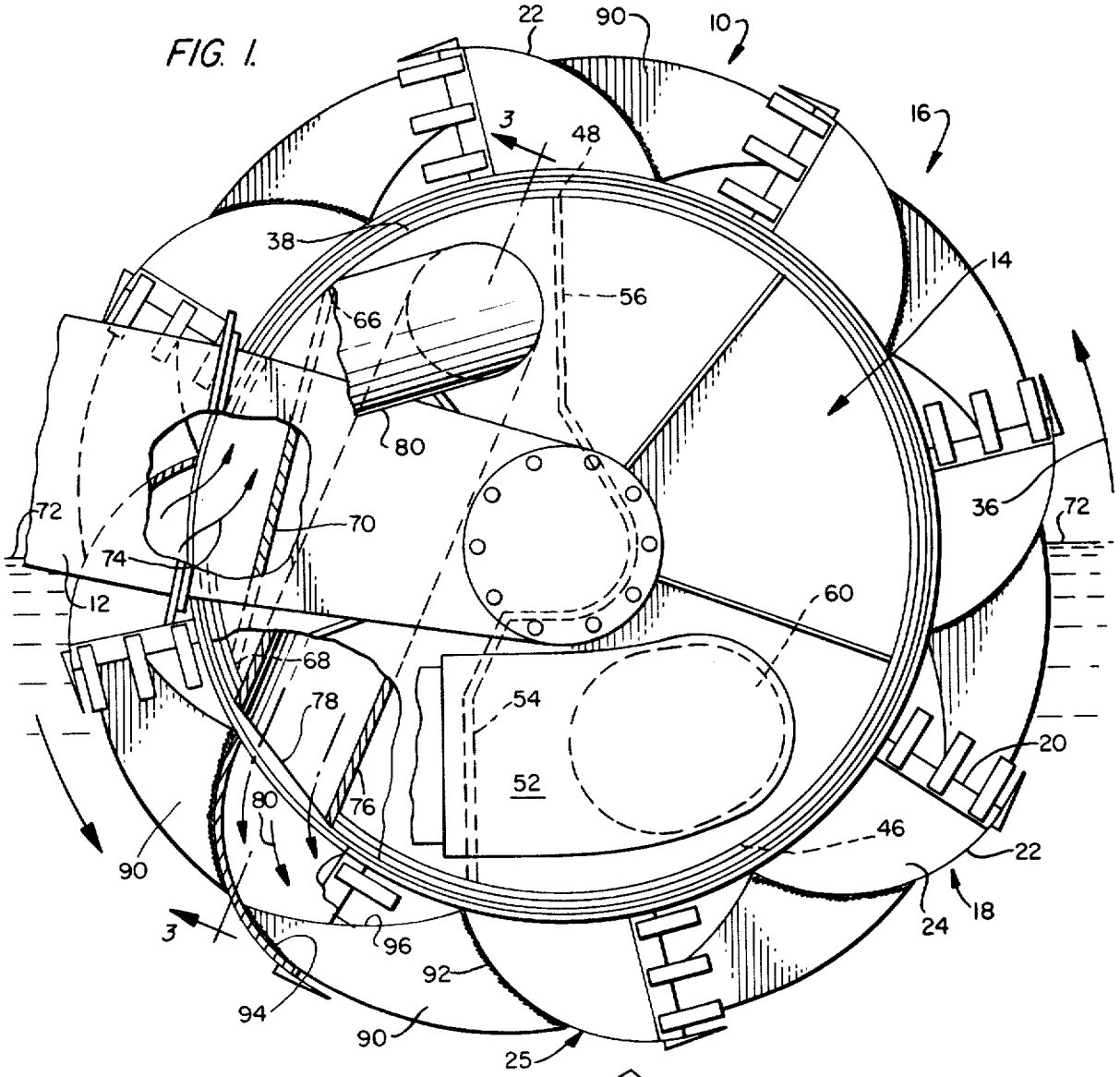
FIG. 1 is a side elevational partly broken, part sectional view of a bucket wheel embracing the features of the invention.

Referring now to the drawings, the numeral 10 designates a bucket wheel incorporating the feature of the invention. The wheel 10 is mounted on the end of a conventional dredge ladder 12 and comprises a stationary hub section 14 and a rotating rim section 16. The rim section 16 comprises a pair of rings 18, 20 which are attached to the opposite sided 22, 24 of a plurality of U-shaped buckets 25 having open bottoms 26 (FIG. 3) and closed tops 28 which slope or curve downwardly and rearwardly from their mouths 30 to the rings 20, 18. The ring 18 is attached to the periphery of a circular plate 32 joined to a shaft 34 which is driven in a conventional manner through gearing (not shown) by a power source, such as a hydraulic motor (not shown), to rotate the plate and rim section in the direction of the arrows 36.

Figure 3:
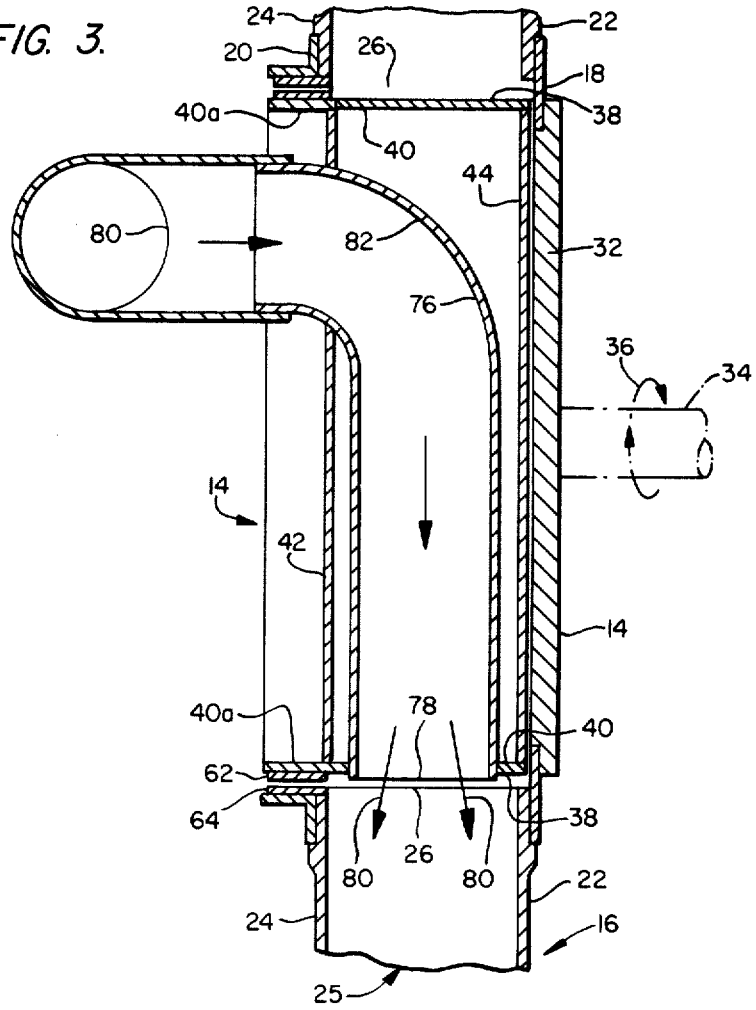
FIG. 3 is a partly schematic, cross-sectional view taken substantially on the line 3—3 of FIG. 1.
Figure 4:
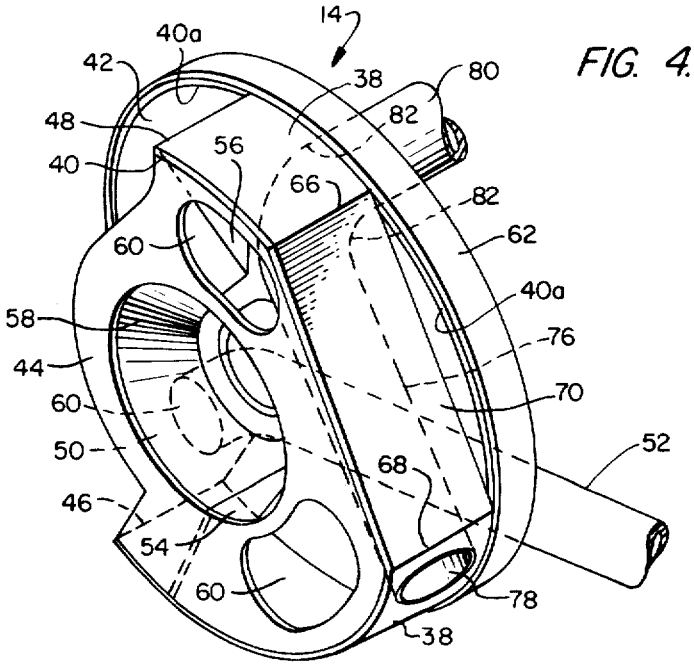
FIG. 4 is a perspective view of the stationary hub section further illustrating features of the invention.

As can be seen in FIG. 3, the buckets are supported by the plate 32 and ring 18 to straddle in cantilever fashion the mid-plane of the wheel. A floor is provided for the buckets by the outer surface 38 of a cylindrical plate 40 whose inner surface is welded to a pair of axially spaced substantially circular side plates 42, 44 of the hub section. The cylindrical plate 40 terminates at edges 46, 48 to define an opening in the plate of approximately 160° of arc leading into a hopper 50 in the hub section to which a suction pipe 52 is connected. The hopper has end walls 54, 56 and its bottom wall 58 (FIG. 4) is preferably sloped in the direction of the outlet 60 to the suction pipe 52. Between the edges 46, 48 of the cylindrical plate 40, the side plate 44 is shown in FIG. 4 as being substantially cut away and as also being provided with lightening holes 60. These are permitted due to the fact that that side of the hub section is substantially closed by the rotatable plate 32 of the rim section as should be apparent in FIG. 3. As can be seen in FIG. 4 cylindrical plate 40 at its extreme right hand side 40*a* defines a complete annulus to which is welded a hoop-like ring 62 positioned so as to be in close adjacency to a similar ring 64 welded to the inner surface of the rim ring 20 which is L-shaped in cross-section as shown in FIG. 3. The rings 62, 64 define wear rings which are acted upon by abrasive spoil and are easily replaced when worn thus vastly prolonging the usable life of the hub and rim section which would otherwise be eroded directly by the abrasive action of the spoil.

What has been described so far is substantially conventional. One of the features of the present invention comprises the provision of clearance path means arranged to permit fluid, particularly air, trapped in the buckets to escape prior to the buckets moving into their spoil engaging position. The wheel of the present invention has been found particularly efficacious in placer mining where often the wheel is only partially submerged in water. Under these conditions, where the cylindrical surface is uninterrupted except over the hopper entrance, air which enters a just emptied bucket as it is moved out of the water remains trapped in the bucket as it re-enters the water in an inverted position enroute to its spoil engaging position. This trapped air can enter the hopper and pass as a bubble through the suction pipe to air-bind the pump. This problem is avoided by the clearance path means of the invention which is desirably provided by cutting away the cylindrical plate 40 to the left, in FIG. 4, of the annular part 40*a* beneath the wear ring 62, over a circumferential extent sufficient to ensure that an escape path for fluid trapped in the buckets may flow freely through the open bottom of the buckets in a direction opposite to the direction of rotation of the rim section. Thus the cylindrical plate is cut at the edges 66, 68 on the side of the bucket substantially opposite the hopper entrance with the cut edges being joined by a flat plate 70 defining a chordal flat in the cylindrical surface so positioned as to be intersected by the surface of the body of water in which the wheel operates partially submerged.

With reference to FIG. 1, it will be seen that the wheel is at least half submerged below the surface 72 of a body of water. As the buckets are moved out of the water and into alignment with the cylindrical surface 38 air enters the buckets upon their emergence from the water and would remain in the buckets as they re-enter the water in an inverted position. Because of the presence of the chordal flat in the otherwise integral cylindrical plate, as the buckets submerge the air therein is expelled by the water entering the buckets, with the air, as shown by the arrows 74, flowing through the open bottoms of the buckets upwardly along the clearance path afforded by the flat between the hub and rim sections to escape back to atmosphere by way of the spaces between the oncoming buckets and the rings 18, 20. By the time the buckets reach the lower edge 68 of the flat plate 70, they are fully submerged with all air previously therein fully and freely displaced by the water so that the buckets align with the lower part of the cylindrical surface 78 in spoil engaging position entirely free of trapped air. As can be seen in FIG. 1, the chordal flat forms a passage extending substantially from a point on the circumference of the wheel which is less than one bucket length's extent below the wheel axis to a point above the wheel axis and the water surface. It can also be seen that the total extent of the passage is less than one fourth the circumference of the bucket wheel and approximately the circumferential extent of two adjacent buckets.

The flat also permits the free flow of water through the buckets when the wheel is fully submerged thus lessening to some degree water resistance to wheel rotation.

A problem with bucket wheel dredges is the adherence of sticky spoil within the buckets. It should be clear that if the buckets are filled with spoil which will not fall or be conveyed into the hopper, dredging operations must cease until the sticky material can be dislodged from the buckets. This is a recognized problem with bucket wheel dredges and one solution has been to arrange a high pressure nozzle so that it projects a stream of water tangentially at the buckets. This is not entirely satisfactory for a variety of reasons, one being that the stream tends to drive the material further into the buckets which is inefficient, and another being that the nozzle must be spaced so as to be clear of the path of movement of the buckets which decreases the effectiveness of the stream particularly if the wheel is operating fully submerged. In addition, the stream acts in opposition to the direction of movement of the buckets.

In accordance with the invention all of the foregoing disadvantages of a tangential stream are eliminated by arranging a flushing pipe 76 within the hub section clear of the hopper. The pipe 76 has its exit 78 arranged to project a flushing stream in a substantially radial direction through an opening in the cylindrical plate 40 positioned rearwardly of the point where the buckets fully engage with the spoil As can be seen in FIG. 3, the exit 78 of the flush pipe 76 can be located so as to be only a fraction of an inch from the open bottoms of the buckets and, as can be seen by the arrows 80 in FIGS. 1 and 3, not only is the flush stream substantially radially projected, but also the material receives the stream from beneath the buckets whereby the material is expelled outwardly through the mouths of the buckets rather than being driven into the buckets as must occur with a tangential flush stream.

The flush pipe 76 within the hub section receives water by way of a pipe 80 and elbow 82 which extends through the hub plate 42. The flush water can be derived from a separate pump which is selectively operated as needed from the dredge hull, or the dredge suction pump itself can be used to supply flush water by use of a suitable cross-over valve. When the suction pump is used for flushing, dredging by the wheel would be temporarily suspended and the suction pump would deliver only clear water to the flush pipe.

A problem with any bucket type wheel used for excavating is that the buckets, having large volumetric capacity, are capable of picking up objects, such as rocks, which are too large to be accommodated in the conveying means such as the suction pipe, leading to the treatment or disposal center, or the rock may be too large to be treated in any event. In order to minimize delays occasioned by the necessity to remove oversized objects from the system and particularly from the hopper, it is desirable to prevent at the outset the entry of such objects into any part of the system. In the earlier U.S. Pat. No. 3,476,498 mentioned above, "grizzly" bars were installed across the entrance to the hopper to prevent the entry of oversized rocks thereinto. The fixed bars, however, did not prevent the buckets from picking up the oversized rocks in the first place. It is desirable to restrict oversized rocks from initially entering the buckets and to this end the prior art, as mentioned above, had proposed the addition of divider plates between pairs of buckets. The problem with the prior art plates is that they extended in cantilever fashion from the back of one bucket to a point just short of the next following bucket and thus were susceptible of being bent to one side so as to permit oversize rocks to enter the buckets and which are difficult to remove past the bent divider plate.

Figure 2:
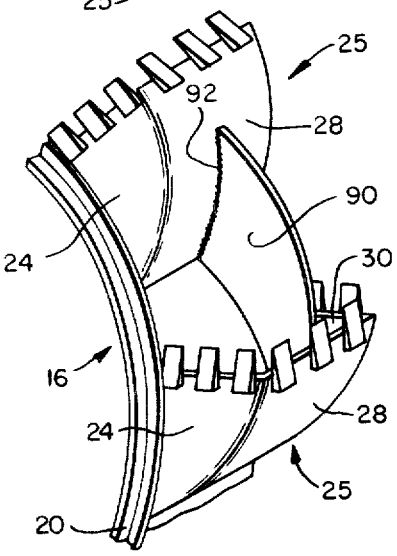
FIG. 2 is a broken, perspective view of a portion of the bucket carrying rim section of the wheel of FIG. 1.

With reference to FIGS. 1 and 2, the present invention improves the arrangement of the prior art by the use of a plate 90 lying in the mid-plane of the wheel between each pair of buckets. The front end 92 of the plate is welded to the upper surface of the top 28 of a leading bucket and the upper edge of the plate extends into the mouth of the following bucket and is welded, as shown at 94 in FIG. 1, to the inner surface of the top of the next following bucket. As can be seen no part of the plate extends radially outwardly beyond the mouth of any bucket and the plate is substantially triangular with arcuate edges, the lower or inner edge 96 being spaced well clear of the bottom of the buckets to permit spoil which is able to pass the plates and enter the buckets to be unimpeded by the plates as the spoil drops into the hopper. By being rigidly supported at both ends, it is virtually impossible for the plates to be bent to one side or skewed out of the mid-plane of the wheel.

Though the plates of the invention are primarily useful for bucket wheel dredges since they exclude oversized rocks from the hopper which are time-consuming to remove, the plates of the invention are also useful for dry land excavators.

The general operation of the bucket wheel is the same as that described in aforementioned prior U.S. Pat. No. 3,476,498 assigned to the same assignee. The operation of the air expeller chordal flat, the bucket flush means and the plates should be apparent from the foregoing description. It will of course be apparent that instead of a chordal flat, other air expeller means might be provided, as for example, arcuate grooves in a continuous surface 38 over the same circumferential extent as the edges 66, 68. Thus, all the features of the invention are susceptible of a variety of modification and changes without, however, departing from the scope and spirit of the appended claims.

What is claimed is:

1. A dredge bucket wheel comprising a relatively stationary hub section and a rim section rotatable with respect to said hub section, said rim section including a plurality of buckets connected together in circumferentially spaced relation, said buckets having radially inwardly open bottoms, said hub section including a spoil receiving hopper having a suction pipe connected thereto, and a substantially cylindrical member whose outer surface is in close adjacency to the open bottoms of said buckets to define a floor therefor, said cylindrical member having an opening therethrough leading to said hopper for depositing therein spoil from said buckets, said wheel including axially spaced, substantially circular side plate means substantially closing the sides of said wheel, and means defining a flow path back to atmosphere for air trapped in said buckets when said bucket wheel is operating at least half submerged, said flow path means comprising passage means formed in the surface of said cylindrical member between said side plates wholly on the side of the bucket wheel axis opposite the opening of said hopper, said passage means communicating the open bottoms of the buckets to atmosphere over a predetermined circumferential distance extending substantially from a point on the circumference of the wheel which is less than on bucket length's extent below the wheel axis to a point above the wheel axis and the water surface, the total extent of the passage means being less than one fourth the circumference of the bucket wheel and approximately the circumferential extent of two adjacent buckets, whereby air which would be otherwise trapped in a submerged bucket is released.

2. The bucket wheel of claim 1 wherein the flow path defining means comprises a chordal flat formed in the surface of said substantially cylindrical member.

3. The bucket wheel off claim 2 wherein said cylindrical member is defined by a cylindrical plate which is cut away over said predetermined circumferential distance and said chordal flat is defined by a flat plate bridging said circumferential distance.

4. A dredge bucket wheel comprising a stationary hub section and a rotating rim section, and rim section comprising a plurality of buckets connected together in circumferentially spaced relation, said buckets having radially inwardly open bottoms, and means operatively connecting said rim section to rotatable driving means, said hub section comprising a spoil receiving hopper having a suction pipe connected thereto, a substantially cylindrical member having an outer surface in close adjacency to the open bottoms of said buckets to define floors therefor, and an opening in said cylindrical member positioned to permit spoil to be deposited through the open bottoms of said buckets into said hopper for removal therefrom by said suction pipe, a stationary, substantially outwardly radially opening port means positioned in the path of movement of the open bottoms of said buckets ahead of their spoil cutting position, and means for selectively delivering pressurized liquid to said port means to project a stream of liquid into said buckets through their open bottoms as they sweep by said port means to dislodge from said buckets any material trapped therein before said buckets arrive at their spoil cutting positions.

5. The bucket wheel of claim 4 wherein said port means is arranged to be in close adjacency to the bottoms of said buckets to minimize the effects of back pressure from surrounding water.

6. The bucket wheel of claims 4 or 5 wherein said port means extends through said cylindrical member and is connected to relatively stationary, substantially radially extending water conduit means disposed within said hub section clear of said hopper, and means for selectively connecting said water conduit means to a source of pressure.

7. In an excavator, a cutter wheel comprising a rotating annular rim section, a plurality of buckets mounted in circumferentially spaced relationship on said rim section, said buckets each having a mouth facing in the direction of normal rotation of said wheel for excavation and a closed top and downwardly extending sides defining a substantially U-shape in cross-section, the top sloping from the open mouth of each bucket downwardly and rearwardly to said rim section, the invention comprising a divider plate between pairs of successive buckets, said plates lying substantially in the mid-plane of the rim perpendicular to the axis of rotation thereof, each divider plate having a front edge integrally joined to the outer surface of the top of one bucket of a pair and having a top edge extending into and integrally joined to the inner surface of the top of the following bucket of a pair, the lower edge of said plate between said buckets being unattached to and radially spaced from said rim section.

8. In the excavator of claim 7 wherein no part of the divider plate extends radially beyond the radial extent of the mouth of each bucket.

9. In the excavator of claims 7 or 8 wherein the front edge of the divider plate extends substantially from the rear inner-most edge of the outer surface of the top of a bucket to which said front edge of said plate is integrally joined to a point intermediate the mouth and said rear inner most edge of said bucket and said plate tapers in the direction of the mouth of the following bucket of a pair whereby there is an outwardly tapering, rearwardly extending clearance between the inner edge of said plate and said rim section.

10. In the excavator of claim 7 wherein said plate is substantially triangular and the inner and outer edges thereof are arcuate.

* * * * *